United States Patent [19]

Wehrli

[11] Patent Number: 5,060,456

[45] Date of Patent: Oct. 29, 1991

[54] APPARATUS AND METHOD FOR DEHEADING AND DISPOSING OF THE HEAD, WRAPPER CRIMP AND PLUG FROM A PAPER ROLL

[75] Inventor: Ivan Wehrli, Montesano, Wash.

[73] Assignee: Enterprises International, Inc., Hoquiam, Wash.

[21] Appl. No.: 591,733

[22] Filed: Oct. 2, 1990

[51] Int. Cl.[5] ..... B65B 69/00

[52] U.S. Cl. ..... 53/492; 53/381.2; 53/381.4; 82/101

[58] Field of Search ..... 53/492, 381.2, 381.4, 53/381.1; 242/56.3; 414/412; 82/101, 92, 93

[56] References Cited

U.S. PATENT DOCUMENTS

| | | | |
|---|---|---|---|
| 1,026,482 | 5/1912 | White | 242/56.3 |
| 2,209,209 | 7/1940 | Ruby | 53/381.2 X |
| 2,364,953 | 12/1944 | Daley | 242/68 |
| 2,641,831 | 6/1953 | Helton | 29/255 |
| 3,067,502 | 12/1962 | Wheatley et al. | 29/255 |
| 3,224,165 | 12/1965 | Nigrelli et al. | 53/382 |
| 3,427,907 | 2/1969 | Gajda et al. | 82/14 |
| 3,466,837 | 9/1969 | Sturges . | |
| 3,822,024 | 7/1974 | Endter et al. . | |
| 3,863,790 | 2/1975 | Kanarek . | |
| 3,889,442 | 6/1975 | Grahn et al. | 53/381 X |
| 3,906,610 | 9/1975 | Hodgetts . | |
| 4,111,084 | 9/1978 | Matsumoto et al. | 82/101 X |
| 4,132,052 | 1/1979 | Larson | 53/381.4 |
| 4,158,417 | 6/1979 | Inoue | 53/381 R |
| 4,177,699 | 12/1979 | Dovnar et al. | 409/132 X |
| 4,191,005 | 3/1980 | Vinoskey | 53/382 |
| 4,285,625 | 8/1981 | Yamada | 53/381.2 X |
| 4,293,086 | 10/1981 | Fincher et al. | 53/374 X |
| 4,534,151 | 8/1985 | Schneck et al. | 82/101 X |

*Primary Examiner*—James F. Coan

*Attorney, Agent, or Firm*—Seed and Berry

[57] ABSTRACT

A rotary cutter rolls on the surface of a wrapped roll and is moved toward the end of the roll while being biased toward the center of the roll. As the cutter reaches the unsupported end of the wrapper, it penetrates the wrapper, cutting the entire wrapper crimp and heads as a unit from the end of the roll. A core plug removing apparatus uses a spear that is inserted within the core plug and a tab protrudes to engage the inside surface of the core plug. As the spear is removed, the tab forcibly pulls the core plug free of the core of the roll. The entire apparatus can be shifted from a removal station to a discharge station where the heads, wrapper crimp and cut plug are removed to a platen. The platen has a slot with an abutment end. A pusher then pushes the heads and wrapper crimp off the platen while the core plug is trapped by the abutment end and is separated from the heads. The heads are then collected in a separate receptacle from the core plug.

21 Claims, 6 Drawing Sheets

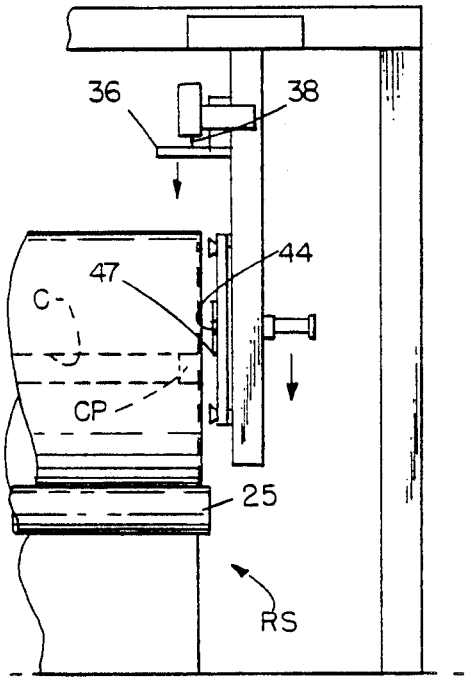
FIG. 8
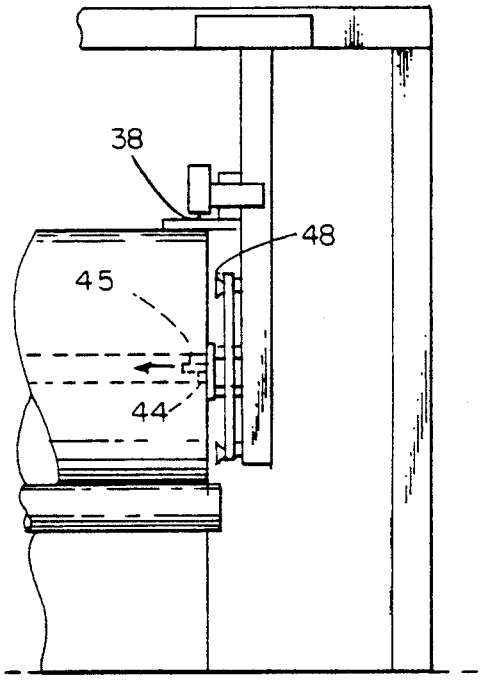
FIG. 9
FIG. 10
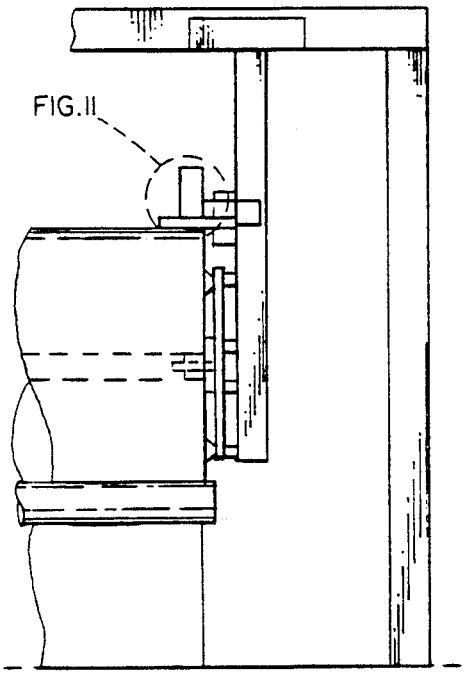
FIG. 11
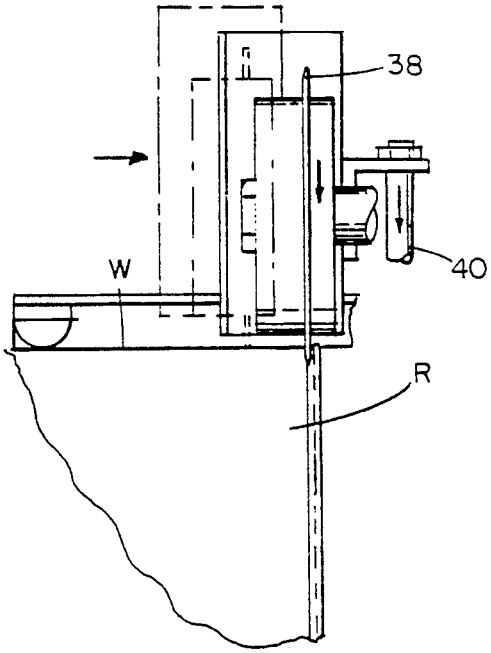

FIG. 12
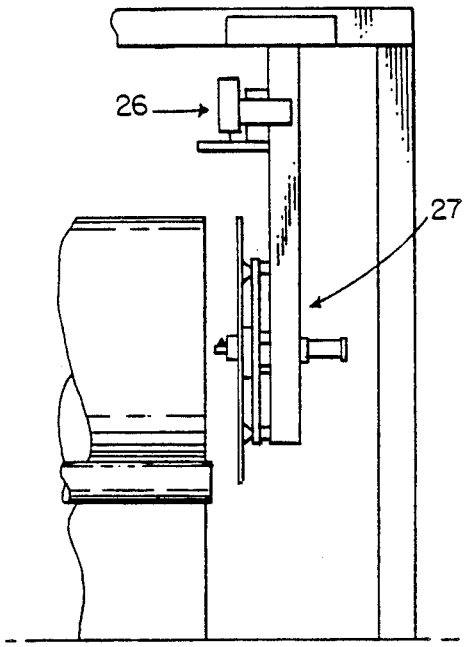
FIG. 14
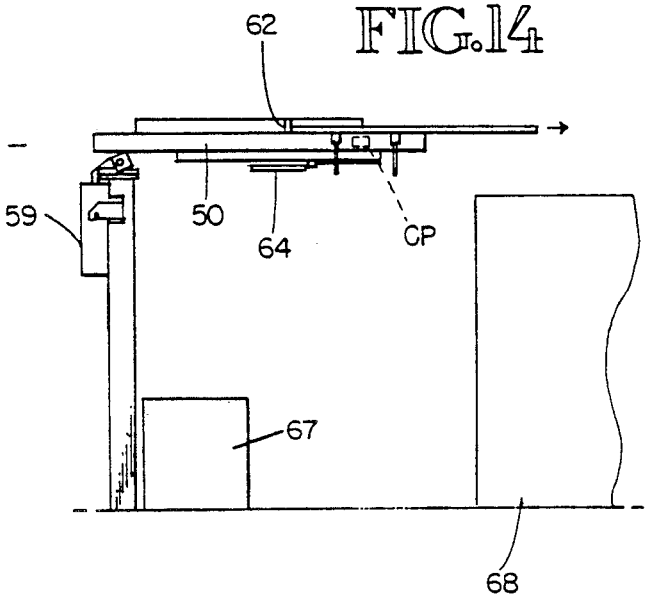
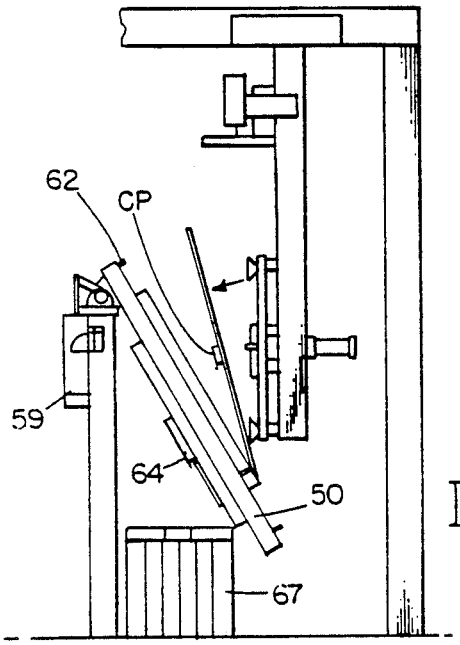
FIG. 13

APPARATUS AND METHOD FOR DEHEADING AND DISPOSING OF THE HEAD, WRAPPER CRIMP AND PLUG FROM A PAPER ROLL

TECHNICAL FIELD

This invention pertains to method and apparatus' for cutting the wrapper crimp and head from cylindrical wrapped objects such as paper rolls, for discharging the wrapper crimp, head and core plug away and separating the core plug from the wrapper crimp and head.

BACKGROUND OF THE INVENTION

Large cylindrical objects, such as rolls of paper for printing presses, are heavy and difficult to handle. These rolls can weigh up to 4,000 pounds and be fifty inches in diameter and fifty-five inches in length. The rolls of paper are wrapped at the paper-making factory with a protective tube-type wrapper that covers the entire cylindrical surface of the roll end overhanging the end of the rolls. Also, the ends of the roll are protected, usually by attaching an inside stiff disk of cardboard, called an inside head, to the end of the paper roll. The wrapper overhanging tube is then glued and crimped down against the inside head. Finally, an outside head, again generally of stiff cardboard, is attached to the crimped wrapper. Frequently the inside head is stapled to a core plug which is inserted into the core of the paper roll to protect the ends of the core against damage.

These paper rolls are wrapped tightly with the wrapper and heads. When it is time to use the roll, the wrapper, heads and core plugs must be removed. In the past, this has been done manually by a workman inserting a knife, hopefully between the end of the roll and the head, and then rotating the roll about its longitudinal axis to cut the wrapper. The plug is removed by manually placing a hook inside of the plug and jerking with considerable force outwardly to separate the plug from the roll.

This technique for cutting the heads and wrapper crimp and removing the plugs is cumbersome and time-consuming. Furthermore, care must be used to not damage the surface of the end of the paper on the roll, or to damage the core which supports the paper. Any damage to the paper will result in a defect appearing in the final product printed on the paper. Damage to the core can make the core unusable for insertion into the printing presses, which rely on tapered pins thrust into the ends of the core for properly positioning the roll.

SUMMARY OF THE INVENTION

It is an object of this invention to provide a method and apparatus for automating the deheading of a roll, including removal of the core plug, without damaging the end of the roll or the core. It is another object of this invention to provide an apparatus for removing the cut head and wrapper crimp and separating the core plug from these heads and wrapper crimps at a discharge station to be disposed of in separate receptacles.

Basically, the apparatus for cutting the wrapper crimp and heads employs a supporting apparatus for rotating the roll about its longitudinal axis, a rotary non-powered knife that is biased downwardly against the outside surface of the wrapper and rolls on the surface of the roll as the roll is rotated. The rotary knife or blade is then also simultaneously moved axially toward the end of the roll until it is no longer supported by the paper in the roll. At this point, there is sufficient force being applied to the rotary knife that it penetrates the wrapper adjacent the end of the roll and inside of the head. Since the knife is not extremely sharp, it will roll along the wrapper without cutting the wrapper so long as the knife is supported by the paper forming the roll. The flat side of the rotary knife, once the knife penetrates the wrapper beyond the end of the roll, will slide against the end of the roll and not damage the end of the paper on the roll. Once the roll is rotated sufficiently to separate the entire head and wrapper crimp, the plug is automatically pulled from the core and the head, wrapper crimp and plug are thus separated from the roll.

In a second feature of this invention, the cut head, wrapper crimp and plug are then removed to a discharge station where the plug is separated from the wrapper crimp and head. In a preferred embodiment, the separation occurs on a platen having an elongated slot which traps the plug. A pusher pushes the head and wrapper crimp along the platen until the plug is free. Subsequently the head and wrapper crimp are pushed off the platen into a collection pallet and the plug is allowed to fall by gravity into a receptacle.

The cutting method includes the steps of pressing a rotary knife against the exterior surface of the wrapper while the roll is rotated. The force pressing the knife being insufficient for the knife to penetrate the wrapper while the knife is supported from beneath by the paper roll. The next step includes moving the knife longitudinally toward the end of the roll until the knife is no longer supported by the paper roll. Then the knife is moved radially into the paper wrapper separating the wrapper and head from the roll as the roll is continued to rotate until a full 360° revolution of the roll occurs while the knife is penetrating the wrapper.

BRIEF DESCRIPTION OF THE DRAWINGS

FIGS. 8–14 are schematic operational views showing the steps of the method and the sequence of operation for cutting the head and wrapper crimp from the roll, removing the head, wrapper crimp and core plug and separating the core plug from the head and cut wrapper crimp.

DETAILED DESCRIPTION OF THE INVENTION

Figure 1:
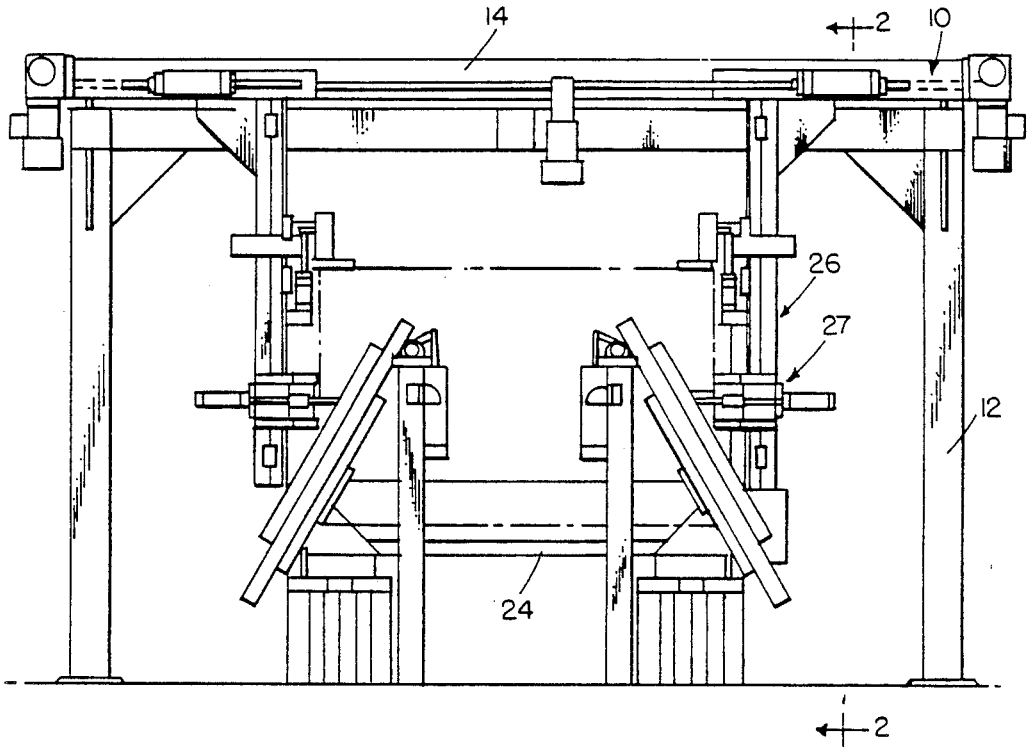
FIG. 1 is a side elevation of an apparatus embodying the principles of the invention.
Figure 2:
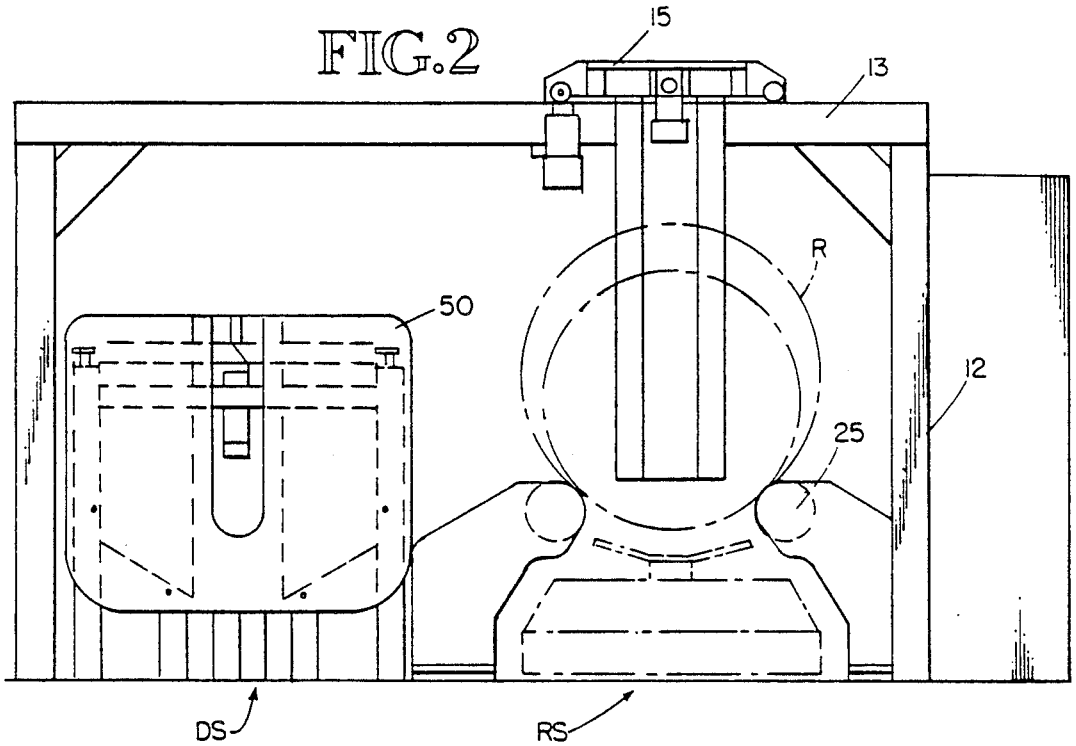
FIG. 2 is a vertical section taken along the line 2—2 of FIG. 1.

As best shown in FIG. 1, the apparatus employs a mainframe 10 having vertical posts 12, and horizontal opposed beams 13. Channels 14 are connected to a carriage 15 that rides along the beam 13. The apparatus on opposite ends of the roll for removing the heads, wrapper crimps and core plugs are substantially identical and mirror images of each other. Accordingly, only one will be described.

The carriage 15 is moved across the beams 13 by a motor 17 a pinion gear 22 across a rack 20 fixed to the beam.

Mounted between the posts 12 and beneath the channel 14 is a roll support station RS. The roll support station has a pair of conventional rotating rollers 25 that are powered to rotate the roll about its longitudinal axis in a known manner.

Positioned adjacent to the roll and moveable relative to the roll is a wrapper cutter apparatus 26 and a core plug removing apparatus 27.

Figure 5:
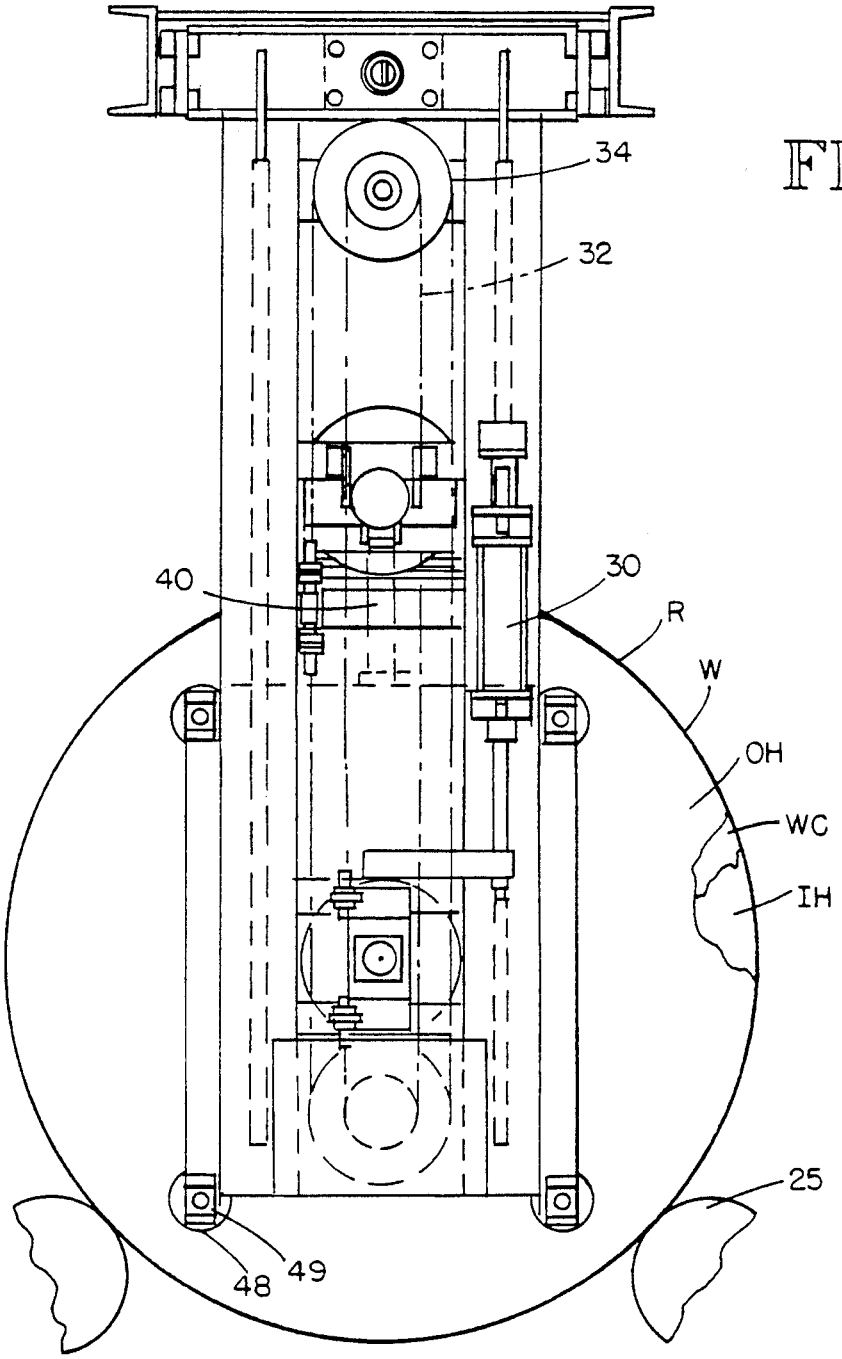
FIG. 5 is a fragmentary vertical section also looking in the direction of the arrow 2—2 of FIG. 1.

As will be best shown in the schematic operational views, the roll R has a wrapper shown in FIG. 5 with a wrapper crimp WC that overhangs and is attached to an inside head IH when an inside head is used. When an inside head is not used, the wrapper crimp is crimped and generally glued directly to the end of the paper roll. In some cases, the inside head will be stapled also to the core plug CP (FIG. 8) that has been inserted into the core C of the roll. An outside head OH is then also generally glued to the wrapper crimp. Generally, if the inside head, wrapper crimp, and outside head and core plug are cut from the end of the roll and the core plug removed from the core, the head(s), crimp, and plug remain intact as a unit until disposed of.

The cutter apparatus 26 is positioned toward and away from the end of the roll in a direction parallel to the longitudinal axis of the roll R by a chain and sprocket drive 28 powered by a gear reduction 18 and a motor 16. The movement is shown in the direction of the arrow 29 in FIG. 3.

Movement of the cutter apparatus horizontally perpendicular to the longitudinal axis of the roll is accomplished by the rack and pinion 20 and 22, as earlier described.

Figures 3, 4:
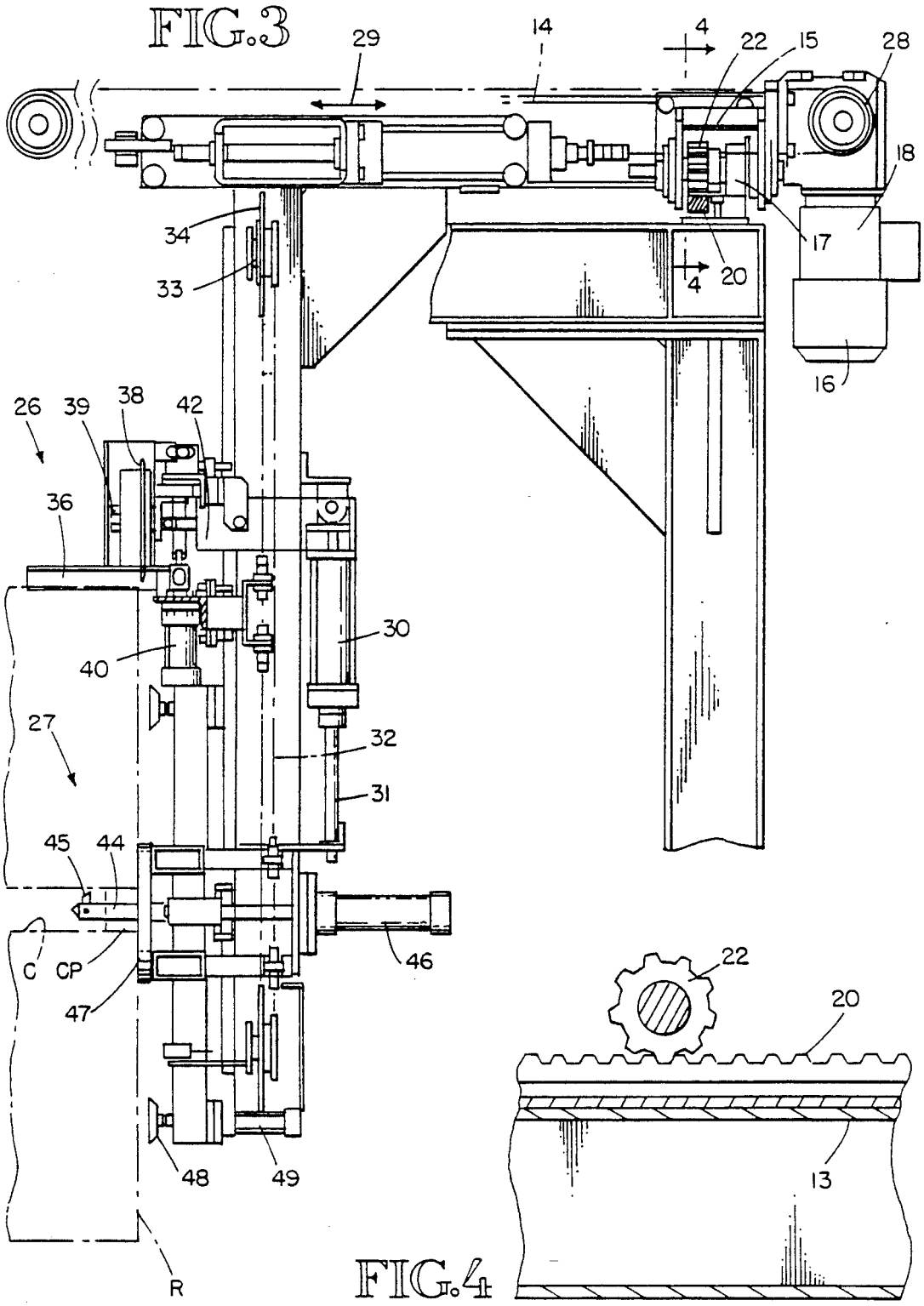
FIG. 3 is an enlarged fragmentary view illustrating components of the apparatus shown in FIG. 1.
FIG. 4 is a fragmentary section taken along the line 4—4 of FIG. 3.

Vertical movement of the cutter apparatus is accomplished by mechanisms best shown in FIGS. 3 and 5. An actuator 30 has a rod 31 that is fixed to a chain and sprocket 32. The chain and sprocket is fixed to an axle 33 that is connected to a second chain and sprocket 34. The sprocket of the chain and sprocket set 34 is twice the diameter of the sprocket in the set 32, so that movement of the actuator causes a point on the chain and sprocket set 34 to move twice the distance as a point on the chain and sprocket set 32.

Connected to the chain and sprocket set 34 is a feeler 36 and a rotary disc-shaped knife or blade 38. The chain and sprocket set 34 apparatus will move the feeler and the rotary cutting blade exactly two times the distance that will be moved by the plug removing apparatus 27. The plug removing apparatus 27 is connected to the chain and sprocket set 32.

The cutter apparatus has a rotary blade that is non-powered, that is, it can freely rotate about an axle 39. An air cylinder 40 pulls the rotary blade down against the surface of the wrapper with a force of approximately 50 kilos per square centimeter. This force is not sufficient and the blade is not sufficiently sharpened to penetrate the wrapper at this force as long as the blade is rolling over a portion of the wrapper that is supported from beneath by the paper roll. The sharpness of the cutting blade and the amount of pressure applied, however, are sufficient that as soon as the rotary blade is moved to the end of the roll and is no longer supported by the paper roll beneath the wrapper, it will penetrate the wrapper and will continue to cut the wrapper close to the end of the roll as the roll is continually rotated by the rollers 25.

The cutter blade is moved toward the end of the roll by a motor and conventional screw drive 42 and moves the cutter blade approximately $\frac{1}{8}$ inch (0.125) from its initial contact point with the wrapper to the end of the roll during an operation.

The plug removing apparatus 27 is fixed to the chain and sprocket 32 and moves one half the distance that the feeler 36 moves. When the feeler 36 is lowered to engage the outer circumference of the roll, its vertical position will vary depending on the diameter of the roll. This movement of the feeler into contact with the circumference of the roll, translates into movement of the plug removing apparatus so that the latter becomes centered over and aligned with the core of the roll as shown in FIG. 3. The plug removing apparatus includes a spear 44 having a retractable barb or tab 45. A cylinder 46 extends and retracts the spear. In its extended position, shown in FIG. 3, the spear passes through the central opening in the core plug CP and the tab 45 is in an open position. The tab 45 preferably retract into the spear as it is advanced into the core plug, but remains rigidly extended when the spear is retracted from the core. In the retracted position, the spear is fully removed from the core and draws the core plug outwardly free from the core. When fully retracted, the tab also becomes retracted into the spear, leaving the plug supported only by the head or heads. The core removing apparatus is also provided with four suction cups 48, each extended and retracted by its own actuator 49. The suction cups are extended into engagement with the outer head when the heads and wrapper crimp have been separated from the roll. At this point the core plug is removed and the head or heads, wrapper crimp and core plug are held solely by the suction cups.

As was described earlier, similar rotary cutting apparatus and core plug removing apparatus are on the opposite side of the machine to cut the heads and wrapper crimp and remove the plug from the opposite end of the roll. Obviously, of course, the entire roll could be rotated about a vertical axis and this operation performed on the opposite roll using the same apparatus at the single station.

It can be seen now that the inner head, if one is attached, wrapper crimp and outer head and the attached core plug are now removed from the roll and suspended by the suction cups at the removal station RS. The heads, wrapper crimp and core plug can then be removed and separated and disposed of manually if desired.

Figure 6:
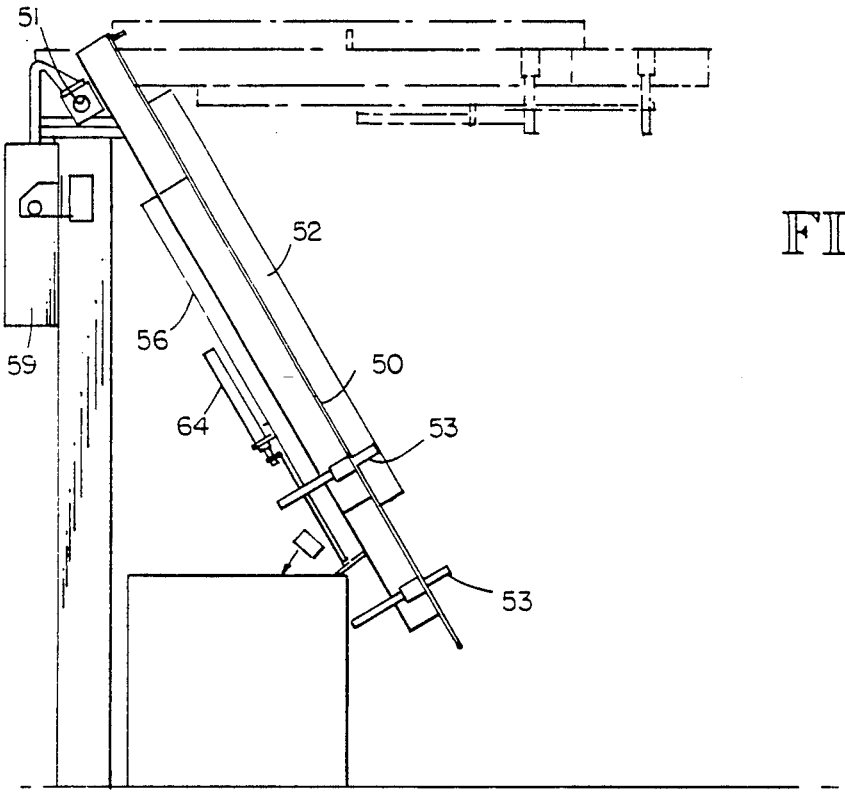
FIG. 6 is a fragmentary side elevation of a cut head, wrapper crimp and core plug separating and removing apparatus.
Figure 7:
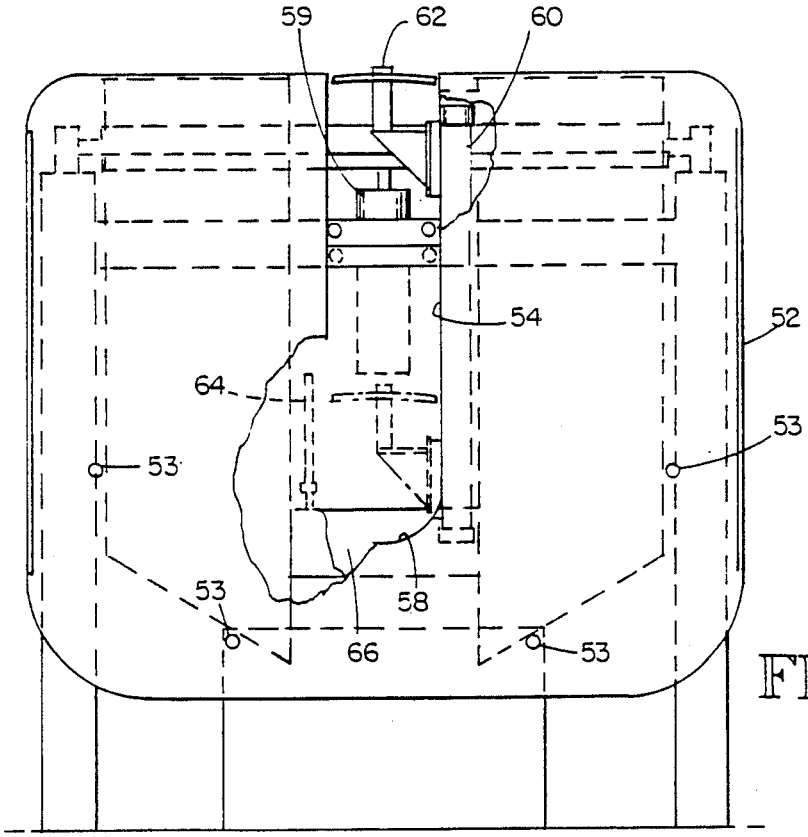
FIG. 7 is an end view of the apparatus shown in FIG. 6.

It is another feature of this invention, however, that an automated discharge station DS is also provided. At the discharge station a platen 50 (FIG. 6) is pivotally mounted at a pivot 51 for movement between an inclined position as shown in FIG. 6 and an elevated horizontal position as shown in FIG. 14. The platen is provided on its top surface with a guide chute 52 for catching the wrapper crimp and heads with plug attached that are deposited by releasing them from the suction cups after the plug removing apparatus 27 has been shifted laterally from the removing station RS by the rack and pinion 20 and 22 to the discharge station DS aligned with the platen. As the heads and wrapper and plug fall, they are caught by the chute and guided into a centered position by pins 53. An elongated slot 54 is provided in the platen. Beneath the slot is a box 56. At the end of the slot is an abutment edge 58. When the heads and wrapper crimp fall onto the platen and are centered, the core plug is seated within the slot 54. The platen is then pivoted by a cylinder 59 into the horizontal raised position shown in FIG. 14. In this position, a conventional shuttle cylinder 60 moves a vertical pusher 62 which engages the end of the head and slides the head and crimp with the core plug attached in the direction of the arrow in FIG. 14. The core plug engages the abutment edge 58 in the end of the slot while the head and wrapper crimp continue to be pushed off the platen. The core plug is thus ripped from the heads and falls into the box 56. After the plane is again lowered, a separate cylinder 64 is then actuated which opens a door 66 in the plug box and allows the plug to fall into a receptacle 67. While the platen was raised the heads and wrapper were pushed off the platen and collected in a pallet or other head collecting box 68.

The operation of the machine is best illustrated in FIGS. 8 through 14. A roll R with a wrapper W and heads attached to a wrapper crimp are shown at the removal station RS in FIG. 8. At this point the feeler 36 is lowered until it engages the roll. The spear 44 is aligned with the core C of the roll and the rotary knife 38 is engaging the wrapper inwardly from the end of the roll, as best shown in FIG. 9. The suction cups 48 are retracted from the outer head at this point and a large circular roller bearing 47 presses the cutter head OH against the end of the roll.

The spear has been inserted through the core plug CP with the tab 45 extending outwardly beyond the opening in the core plug.

The rotary blade is then moved longitudinally toward the end of the wrapper and biased downwardly, as shown in FIG. 11, until it penetrates the wrapper closely adjacent the end of the roll. The cutter rotates relative to the roll by the rotary motion of the roll, but is not otherwise rotated independently. The pressure toward the center of the roll applied by the cylinder 40 maintains a sufficient pressure to have the blade cut the wrapper only when it has passed off the end of the roll, as shown in FIG. 11. In this manner, the blade does not inadvertently cut the good paper being protected by the wrapper and does not engage the end of the roll with its sharpened edge so as to cause damage to the end of the roll. Continued rotation occurs until the heads, wrapper crimp and plug are completely separated. The suction cups hold the head or heads, crimp, and plug as a unit, as shown in FIG. 12.

The carriage 15 is then moved laterally until the core plug, inner head, if used, wrapper crimp and outer head are dropped onto the platen 50. Next, the platen is tilted up to the horizontal position shown in FIG. 14, and the pusher 62 moved to the right, pushing the head off the platen and separating the core plug from the heads and wrapper crimp. The heads and wrapper crimp slide off into a collection box 68. The platen is then lowered again to its inclined position and the cylinder 64 operated to open the door 66 of the core plug box 56 so that the plug can then fall into a receptacle 67.

While the preferred embodiments of the invention have been illustrated and described, it should be apparent that variations will be apparent to those skilled in the art. It is particularly important to note that the core plug removing apparatus can be used as a separate component in this and other machines. The rotary cutting blade technique is unique both in its apparatus configuration and in its unique method of steps for operating on the wrapper and heads. Furthermore, the head and wrapper crimp removing apparatus with its separate apparatus for separating the core plug is also separately usable in other configurations. Therefore, the invention is not to be limited to the specific description given herein, as variations will be apparent to those skilled in the art.

I claim:

1. Apparatus for removing the head from a cylindrical roll of the type having a core, paper or other material wound on said core to form a large diameter roll with a longitudinal axis, a core plug inserted in each end of the core, a protective wrapper around the roll, and at least one head covering each end of the roll, the apparatus comprising:

means for rotating the roll about the longitudinal axis, cutter means movable along the exterior surface of the wrapper toward an end of the roll, said cutter means including a rotary blade, blade biasing means for moving the blade toward the end of the roll and for moving the blade toward the longitudinal axis of the roll for pressing the blade along the wrapper until it is no longer supported by the roll and then penetrates the wrapper adjacent the end of the roll to sever the wrapper and head from the roll.

2. The apparatus of claim 1, wherein the blade is not separately powered for rotation and wherein the wrapper has an end crimp folded over the end of the roll, the rotary blade severing the end crimp from the roll.

3. The apparatus of claim 2, including core plug removing means having a spear insertible within the core plug, an actuator for inserting the spear into the plug, a tab extendible laterally of the spear within the core, said actuator when retracted pulling the tab against the plug to free the plug from the core.

4. The apparatus of claim 2, further including cutter and spear positioning means having an actuator for rotating a pair of sprockets and chains, a roll surface feeler attached to one of said pair and the core plug removing means attached to the other of said pair of sprockets and chains, the ratio of the sprockets and chains being two to one so that movement of the actuator translates into the core plug removing apparatus to move one half the distance of the feeler for centering the spear on the longitudinal axis of the roll.

5. The apparatus of claim 2, further including means for removing the severed wrapper and head.

6. The apparatus of claim 3, further including cutter and spear positioning means having an actuator for rotating a pair of sprockets and chains, a roll surface feeler attached to one of said pair and the core plug removing means attached to the other of said pair of sprockets and chains, the ratio of the sprockets and chains being two to one so that movement of the actuator translates into the core plug removing apparatus to move one half the distance of the feeler for centering the spear on the longitudinal axis of the roll, and further including means for removing the severed wrapper and head.

7. The apparatus of claim 5, said means for removing the severed wrapper and head including a plurality of suction cups for attaching to the head, the head being attached to said core plug, head shifting means for moving said suction cups laterally to a head disposing station, platen means at said head disposing station for receiving said head and attached plug, means for pivoting the platen from an inclined receiving position to a horizontal head discharge position, and means on said platen for separating the core plug from the head and removing the head from the platen.

8. The apparatus of claim 7, said means for separating the core plug from the head and removing the head from the platen including a slot in the platen for receiving the plug, said slot having an abutment end, a head pusher, an actuator for pushing the pusher for moving the head and plug toward said abutment and whereby the plug is trapped and falls from the head while the head continues to be pushed off the platen.

9. The apparatus of claim 2 including rotary blade positioning means, said rotary blade positioning means including a mainframe, first drive means for advancing the rotary blade parallel to the roll longitudinal axis, second drive means for moving the rotary blade horizontally perpendicular to the roll longitudinal axis, and third drive means for moving the rotary blade vertically perpendicular to the longitudinal axis of the roll.

10. The apparatus of claim 3, including rotary blade and spear positioning means, said rotary blade and spear positioning means including a mainframe, first drive means for advancing the rotary blade and spear parallel to the roll longitudinal axis, second drive means for moving the rotary blade and spear horizontally perpendicular to the roll longitudinal axis, and third drive means for moving the rotary blade and spear vertically perpendicular to the longitudinal axis of the roll, said third drive means including an actuator for rotating a pair of sprockets and chains, a roll surface feeler attached to one of said pair and the spear attached to the other of said pair of sprockets and chains, the ratio of the sprockets and chains being two to one so that movement of the actuator translates into the spear to move one half the distance of the feeler for centering the spear on the longitudinal axis of the roll.

11. The apparatus of claim 2, said roll including an inside head inside the crimp of the wrapper and an outside head located outside the crimp of the wrapper, said heads and wrapper crimp being glued together, said outside head attached to said plug, said rotary blade passing between the end of the roll and the inside head to separate the heads, wrapper crimp and plug from the roll as a single unit.

12. Apparatus for automatically removing a core plug from the core of a roll of the type having a hollow elongated core, having opposite ends and an elongated axis, paper or like material wound on said core, a tapered core plug firmly seated in each end of said core, each plug having a hole, and inner and outer end surfaces, the apparatus comprising:

an elongated spear insertible along the longitudinal axis of the core, a tab on said spear extendible laterally inside the core beyond the plug, and an actuator for advancing and retracting the spear for inserting the tab within the core and pulling the tab out of the core against the inner end surface of the plug to free the plug from the core, and means for positioning the spear and tab on the longitudinal axis of the core.

13. Apparatus for separating and discharging a severed head and wrapper crimp from an attached core plug comprising:

a removing station having a wrapped roll, means for supporting the roll at the removing station, and means for cutting a head and wrapper crimp with a core plug attached from the wrapped roll, a discharge station remote from said removing station and having a platen for receiving the head, wrapper crimp and core plug, said platen having a lowered position inclined to receive the head, wrapper crimp and core plug and position them by gravity, means for separating the plug from the head and wrapper crimp on the platen, and means for removing the head and wrapper from the platen separate from the plug.

14. The apparatus of claim 13, said means for separating the plug including an elongated slot on said platen terminating in an abutment edge, a head pusher for pushing said head, wrapper crimp and plug along said platen with the plug seated into the slot, wherein continued movement of the head pusher moves the plug against the abutment edge to trap the plug and moves the head and wrapper crimp beyond the abutment edge and off the platen on to a collector to separate the plug from the head end wrapper crimp.

15. The apparatus of claim 14, said platen having a discharge port, a sliding gate closing said port, and an actuator for opening the gate to drop the separated plug into a receptacle.

16. Apparatus for separating and discharging a severed head and wrapper crimp from an attached core plug comprising:

a discharge station having a platen for receiving the head, wrapper crimp and core plug, means for separating the plug from the head and wrapper crimp on the platen, and means for removing the head and wrapper from the platen separate from the plug.

17. The method of cutting a head and wrapper crimp from the end of a roll comprising rotating a wrapped and headed roll about the longitudinal axis of the roll, rolling a blade along the wrapper by rotating the roll relative to the blade, pressing the blade against the wrapper with a force that will not penetrate the wrapper while the blade is supported by the roll but will penetrate the wrapper if the blade moves beyond the end of the roll, moving the blade longitudinally of the roll until the blade presses beyond the end of the roll to penetrate the wrapper between the end of the roll and the head, and continuing to rotate the roll until the entire head and wrapper crimp are severed.

18. The method of claim 17, including the step of gripping the cut head and crimp free of the roll.

19. The method of claim 17 wherein the roll has a core plug, and including the step of pulling the plug free of the core.

20. The method of claim 19 including the step of gripping the cut head, crimp, and plug free of the roll.

21. The method of claim 19 including the step of separating the plug by shifting the cut head and crimp parallel to the surface of the head while holding the plug until the plug is separated from the head and crimp.

* * * * *